US005882126A

United States Patent [19]

Bowling

[11] Patent Number: 5,882,126

[45] Date of Patent: Mar. 16, 1999

[54] LATERALLY ADJUSTABLE PRINT HEAD

[75] Inventor: Kinred Bowling, Montgomery County, Ohio

[73] Assignee: Premark FEG L.L.C., Wilmington, Del.

[21] Appl. No.: 22,937

[22] Filed: Feb. 12, 1998

[51] Int. Cl.[6] ..... B41J 11/20

[52] U.S. Cl. ..... 400/55; 400/58; 101/288

[58] Field of Search ..... 400/208, 663, 400/55, 56, 509, 58; 101/288; 156/284

[56] References Cited

U.S. PATENT DOCUMENTS

| | | | |
|---|---|---|---|
| 4,048,913 | 9/1977 | Navi | 101/27 |
| 5,133,611 | 7/1992 | Nakajima | 400/120 |
| 5,388,919 | 2/1995 | Kimura et al. | 400/55 |
| 5,414,450 | 5/1995 | Oshino et al. | 342/197 |
| 5,473,984 | 12/1995 | Terrell, Jr. et al. | 400/120 |
| 5,599,113 | 2/1997 | Suzuki et al. | 400/120.16 |
| 5,615,960 | 4/1997 | Mori et al. | 400/613 |
| 5,694,159 | 12/1997 | Kajiya et al. | 347/197 |
| 5,717,444 | 2/1998 | Sugimoto et al. | 347/29 |

FOREIGN PATENT DOCUMENTS

| | | |
|---|---|---|
| 62107801 | 11/1988 | Japan . |
| 62296598 | 5/1989 | Japan . |

*Primary Examiner*—Edgar Burr
*Assistant Examiner*—Dave A. Ghatt
*Attorney, Agent, or Firm*—Thompson Hine & Flory LLP

[57] ABSTRACT

A print head assembly for use in a printer which includes a platen roller positioned adjacent a paper path and a first positioning member associated with the platen roller includes a print head and a support for the print head. The support is positioned for sliding along a longitudinal member. A second positioning member extends from one of the print head and the support for movement therewith. The second positioning member slides into contact with the first positioning member to position the print head relative to the platen roller. A cam follower arrangement urges the print head into engagement with the platen roller.

18 Claims, 4 Drawing Sheets

LATERALLY ADJUSTABLE PRINT HEAD

BACKGROUND OF THE INVENTION

The present invention relates to printers and more specifically to printers which employ a thermal line printing head to print images on thermal sensitive paper and still more particularly to printers in which the print head is used in conjunction with a platen roll which is mounted in a label cassette which is removable from the printer.

Compact printers using thermal line print heads are well known and widely used. One application in which thermal printers have been used is in printing labels for packaged food items. It is not unusual to use such printers in the deli, fresh produce and meat departments of a grocery store to print labels. In a typical printer the print head is used in association with a print or platen roller. The print head typically abuts the platen roller during the printing operation and the platen roller holds the label stock against the face of the print head. The platen roll is frequently formed from rubber or a similar compound of sufficiently low durometer to provide a large area of contact. In many cases the platen roller also functions as a drive roll to advance the label stock through the printer. If the print head is not correctly positioned or becomes misaligned with the platen roller, the print quality can become very poor. In particular, image sharpness and intensity can diminish. Accordingly, in designing printers, it is generally necessary to provide some means for adjusting the alignment between the print head and the platen roll so as to enable the user to maintain good print quality.

Printers that are used in grocery stores in some cases have been designed with a removable cassette in which the label stock is supplied. It is not unusual to use multiple cassettes in conjunction with a single printer. For example, one cassette may carry labels of a first length and another cassette may be used to carry labels of a second length. Different cassettes may also be used to supply linered label stock and linerless label stock.

The use of interchangeable cassettes with a single printer presents problems in aligning the print head when the platen or print roller is housed within the cassette because the position of the platen roller relative to the print head may not be the same in one cassette as another and print quality may suffer. The difference in positions may be the result of manufacturing variances or the cassette not seating itself in the identical position each time it is loaded into the printer. Nevertheless, it is considered advantageous to mount the platen roller in the cassette because it provides easier access to the print head for cleaning and replacement and it also simplifies loading the label stock in the printer.

U.S. Pat. No. 5,694,159 to Kajuja et al discloses a thermal printer having a removable print head wherein the print head is biased by springs into contact with a platen roller. However, while this construction may be helpful in positioning the print head on the platen roller, this construction does not address the lateral adjustment that is often required when loading different cassettes into a single printer.

SUMMARY OF THE INVENTION

Accordingly, the primary object of the present invention is to provide an improved printer and, more particularly, to provide a printer in which the print head is laterally adjustable such that it can compensate for changes in the position of the platen roller. By "laterally adjustable" is meant that the print head can be moved backward or forward in a direction parallel to the paper path. In accordance with the preferred embodiment of the invention, the print head is not only laterally adjustable but it is also transversely adjustable with respect to the platen roller. By "transversely adjustable" is meant that the print head is biased in a direction perpendicular to the paper path.

DETAILED DESCRIPTION OF THE EMBODIMENTS

Figure 1:
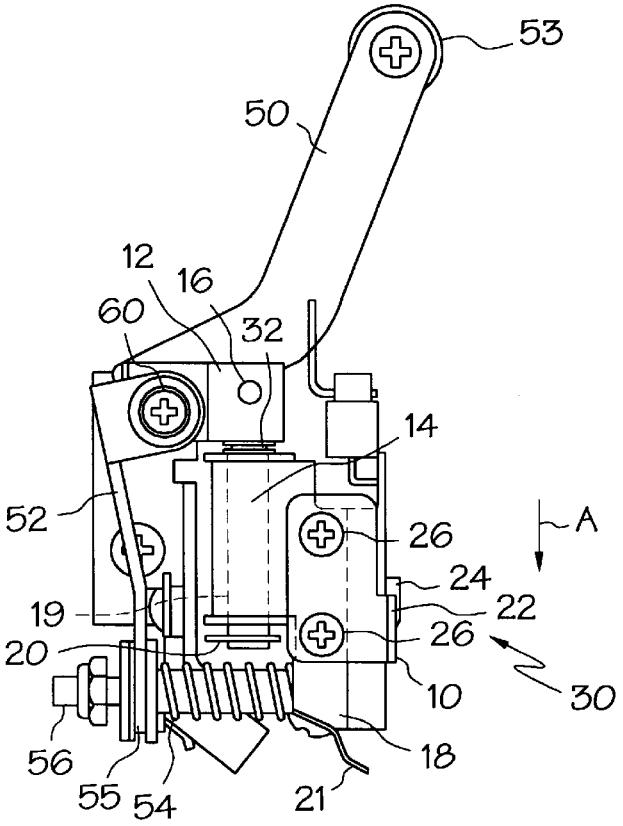
FIG. 1 is an overhead view of a print head assembly in accordance with the invention.
Figure 2:
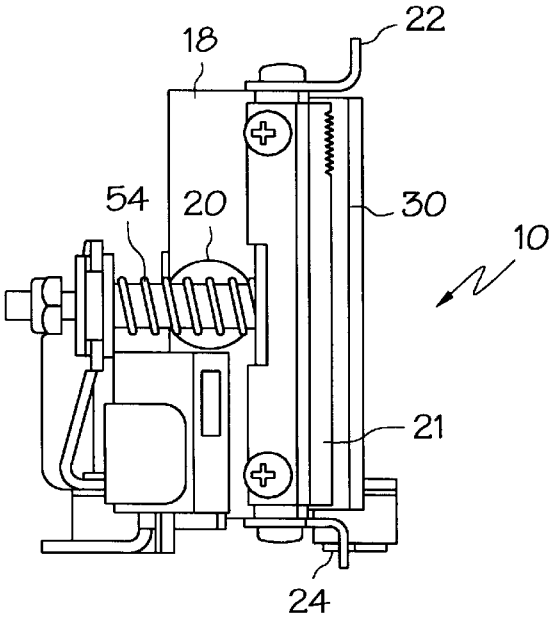
FIG. 2 is an elevational view from the downstream end of the assembly.
Figure 3:
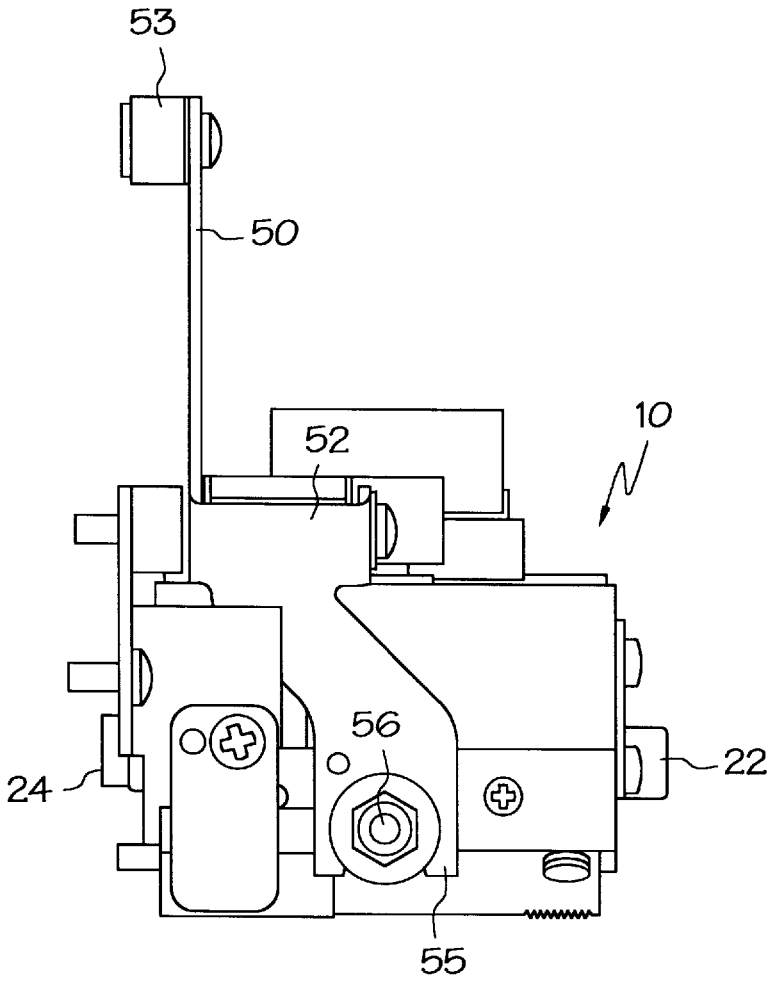
FIG. 3 is a side elevational view of an assembly for a print head in accordance with the present invention.

The preferred embodiments of a print head assembly according to the present invention are detailed hereinafter with reference to the accompanying drawings. As shown in FIG. 1, the print head assembly 10 includes a mounting block 12 on which the assembly can be mounted in a printer. A shaft 14 extends laterally from the block in a direction which is parallel to the path in which the paper labels travel in the printer as designated by the arrow in the drawing. The shaft 14 can be retained in the block 12 by a set screw 16 or other methods of securing the shaft in the block may be used such as threads or an adhesive. A print head support 18 is carried on the shaft 14 by means of a cylindrical bore 19 which extends through the support. The support 18 is able to slide on the shaft 14 and can be retained on the shaft 14 by a locking ring 20. The support preferably functions as a heat sink for the print head and is formed of a suitable metal such that when the print head is secured to the support extraneous heat is conducted away from the print head. The print head 30 is located and retained on the support 18 between positioning tabs 22 and 24 each of which is held on opposite ends of the support by a pair of a srews 26. A compression spring 32 is provided on the shaft 14 between the block 12 and the support 18 so as to bias the support 18 laterally along the paper path indicated by the arrow A. An arm 50 on bracket 52 extends to the side of the block 12 and has a cam follower 53 at its distal end. Yoke portion 55 of bracket 52 compresses the spring 54 as the cassette is inserted into the printer as explained below. The print head 30 is transversely biased into contact with the platen roller by the spring 54 which is mounted on the transverse adjustment shaft 56.

Figure 4:
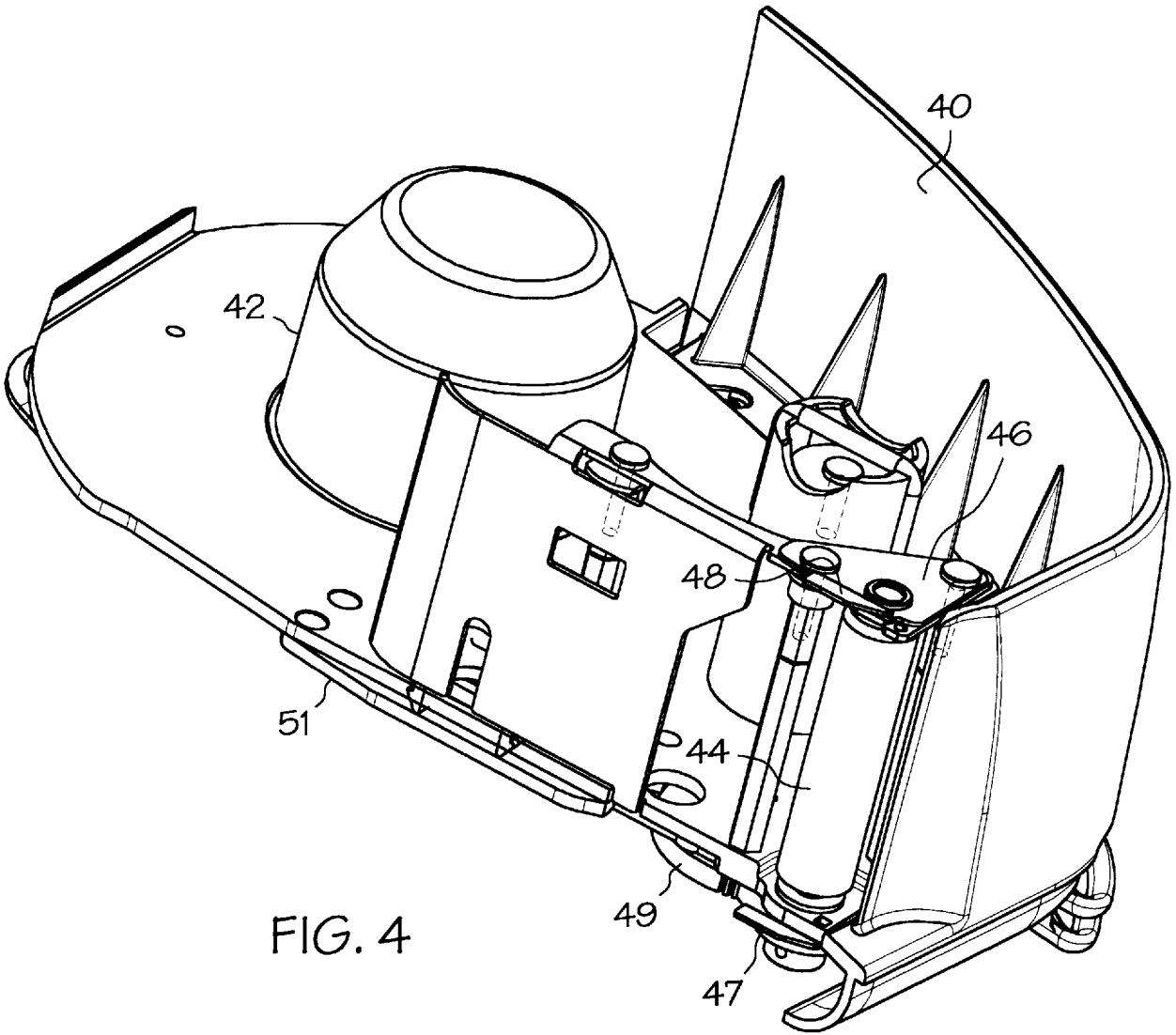
FIG. 4 is a perspective view of a cassette assembly in accordance with the invention.
Figure 5:
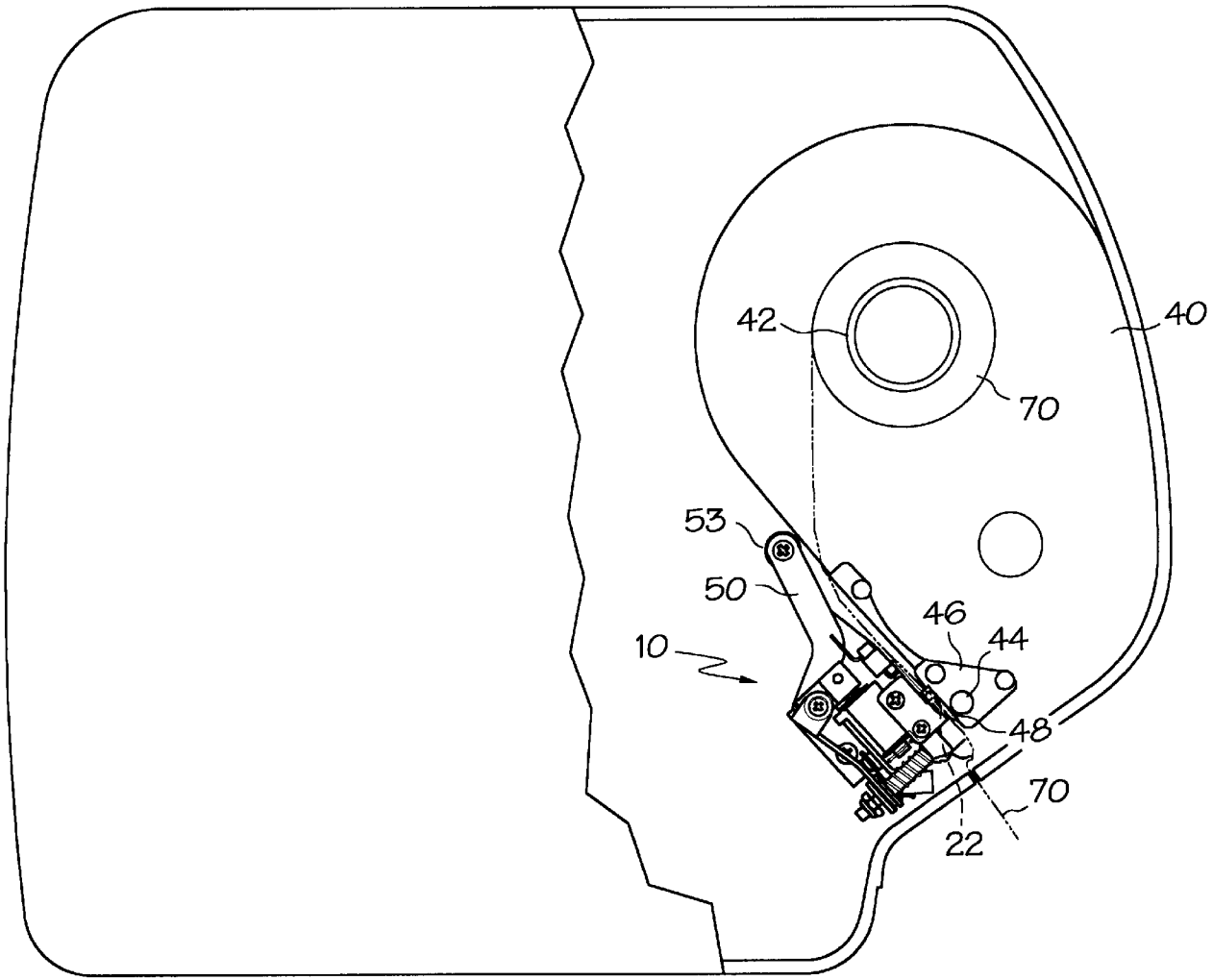
FIG. 5 is a top plan view of a scale which incorporates a printer and cassette in accordance with the invention.

FIG. 4 illustrates a label stock cassette 40 which includes a hub 42 for mounting a roll of label stock and a platen roll 44. The platen roll 44 is mounted at the periphery of the cassette between a pair of plates 46 which also function as guides for the labels. The label stock 70 is printed as it passes between the print head and the platen roller and thereafter, the labels exit the printer. The roller 44 is joined to a gear at one end which gear forms part of a gear train 49 in the cassette. The cassette geartrain 49 cooperate with gearing in the printer (not shown) such that roller 44 is rotated by the gears 49 when the cassette is inserted into the printer and the label feed is activated. A pair of positioning tabs 47 and 48 is provided on the plates 46. These positioning tabs abut the positioning tabs on the print head assembly as described later. By abutting the tabs 47 on the platen roller plates with the tabs on the print head assembly, the relative positions of the print head in the printer and the platen roller in the cassette can be fixed.

Upon inserting the cassette into the printer a cam surface 51 on the cassette 40 contacts the cam follower 53 on the arm 50. As the cassette is moved into the printer, surface 51 forces the arm 50 to rotate the print head assembly about pivot point 60. At the same time the print head assembly is moved backward slightly (opposite direction A). Rotation of the block 12 causes the bracket 52 to compress the spring 54 on transverse adjustment shaft 56 thereby providing a small transverse biasing force. After the cassette is inserted into the printer, and the printer is activated, the label stock is advanced by platen roll 44. The drag of the label stock against the print head 30 pulls the print head laterally along the paper path A whereupon, under the force of compression spring 32, the position tabs 47 and 48 on the platen roller end plates contact the position tabs 22 and 24 on the print head assembly. The tabs on the print head assembly and the tabs in the cassette are located with respect to one another such that a fixed lateral position is established between the platen roller 44 and the print head 30. In this position, spring 54 biases the print head into contact with roller 44. As printed labels are dispensed from the printer, they are cut along serrated tear plate 21.

Those skilled in the art will recognize that numerous variations on the illustrated embodiment of the invention are possible. In particular, while the invention has been illustrated using a pair of positioning tabs in the cassette and on the print head assembly, it is also feasible to use a single tab in the cassette which mates with a single tab on the print head assembly. The position of the tabs can also vary provided insertion of the cassette into the printer is accompanied by contact of the tabs and a slight inward shift of the print head assembly. Furthermore, the invention has been explained with reference to spring biasing member 12 encircling the shaft 14 but it will also be apparent that the spring member could be positioned adjacent the shaft and that a pair of spring members could be used. Likewise, other biasing members could be used to laterally bias the support such as certain rubber or elastomeric elements. In another embodiment, the shaft 14 need not have a circular crosssection but may have any convenient shape that permits the support to slide easily thereon. In still another embodiment, a plurality of shafts could be used instead of a single one and other constructions could be used in place of the shaft 14 such as a pair of rail members that is adapted to slide in slots on the sides of the support.

What is claimed is:

1. A print head assembly for use in a printer in which a web of label stock travels along a paper path, comprising a print head a support for the print head, said support being mountable within a printer such that the support slides along a path which is parallel to the paper path;

a post which extends along said path;

wherein said support includes a passageway and said post passes through said passageway such that said support slides on said post;

a spring positioned against said support and biasing said support to slide along said path.

2. The print head assembly of claim 1 wherein said print head includes a first positioning member which contacts a second positioning member associated with a platen roller to position the print head with respect to the platen roller.

3. The print head assembly of claim 1 wherein a locking ring is provided at the distal end of said post for retaining said support on said post.

4. The printer of claim 1 wherein said cassette includes a cam surface and said print head assembly includes a cam follower such that upon inserting said cassette into said printer said print head assembly is pivoted into transverse abutment with said platen roller.

5. The printer of claim 4 wherein said platen roller is located at the periphery of said cassette between a pair of end plates and a positioning tab is located on each of said end plates.

6. The print head assembly of claim 4 further comprising a mount block, a bracket pivotally connected to said mount block, a transverse adjustment shaft extending from said support, and a biasing member, said bracket including a first arm member which carries said cam follower and a second arm member which extends to said transverse adjustment shaft, said biasing member positioned on said transverse adjustment shaft between said second arm member and said support.

7. The print head assembly of claim 1 further comprising a mount block and a first arm member, said first arm member extending from said mount block and carrying a cam follower.

8. The print head assembly of claim 7 further comprising a second arm member and a biasing member, said first arm member connected to pivot said second arm member which extends from said mount block, said biasing member positioned between an end of said second arm member and said support, wherein said print head is urged toward the paper path by said biasing member upon contact between said cam follower and a cam surface of a cassette inserted in the printer.

9. The print head assembly of claim 8 wherein said first arm and said second arm are formed integrally as a bracket which is pivotally connected to said mount block, said post extending from said mount block, said biasing member comprising a spring.

10. A printer comprising a removable cassette for receiving label stock, said cassette having a platen roller mounted therein, a print head assembly, a support for said print head, said support being mountable within said printer such that said support slides along a path which is parallel to a label stock path of said printer, wherein said cassette includes a first positioning member and said print head assembly includes a second positioning member and said first and second positioning members are located such that they abut one another and thereby establish a predetermined placement of said print head with respect to said platen roller.

11. The printer of claim 10 wherein upon inserting said cassette into said printer and feeding label stock from said printer, said first positioning member contacts said second positioning member.

12. A print head assembly for use in a printer which includes a platen roller positioned adjacent a paper path and a first positioning member associated with the platen roller, said print head assembly comprising a print head, a support for said print head, a longitudinal member, said support positioned for sliding along said longitudinal member, a second positioning member extending from one of said print head and said support for movement therewith, said second positioning member sliding into contact with the first positioning member to position said print head relative to the platen roller.

13. The print head assembly of claim 12 wherein said print head engages a web of printable stock when positioned within the printer, and wherein frictional engagement between said printable stock and said print head urges said support to slide along said longitudinal member such that said second positioning member contacts said first positioning member.

14. The print head assembly of claim 13 further comprising a first arm extending from said assembly and carrying a cam follower.

15. The print head assembly of claim 14 further comprising a second arm and a spring, said first arm connected to pivot said second arm, said spring positioned between said second arm and said support, wherein said second arm and said spring bias said print head into transverse abutment with the platen roller upon contact between said cam follower and a cam surface of a cassette inserted in the printer.

16. The print head assembly of claim 15 further comprising a transverse adjustment shaft extending from said support, said spring disposed on said transverse adjustment shaft.

17. The print head assembly of claim 15 wherein said first arm and said second arm are formed integrally as a bracket which is pivotally connected to a mount block of said assembly, said longitudinal member comprising a post which extends from said mount block.

18. A method for aligning a print head in a printer with a platen roller in a cassette which comprises:

providing a printer including a print head assembly including a print head and a support for said print head, said support being mountable within said printer such that said support slides along a path substantially parallel to a paper path in said printer, said print head assembly including a first positioning member, providing a cassette including a platen roller and a second positioning member associated with said platen roller, inserting said cassette into said printer, and contacting said first positioning member and said second positioning member to position said print head with respect to said platen roller.

* * * * *

UNITED STATES PATENT AND TRADEMARK OFFICE

CERTIFICATE OF CORRECTION

PATENT NO. : 5,882,126

DATED : March 16, 1999

INVENTOR(S) : Kinred Bowling

It is certified that error appears in the above-identified patent and that said Letters Patent is hereby corrected as shown below:

In claim 4, line 1, replace "1" with --10--.

Signed and Sealed this

Seventeenth Day of August, 1999

*Attest:*

Q. TODD DICKINSON

*Attesting Officer*

*Acting Commissioner of Patents and Trademarks*